United States Patent [19]

Grasseschi

[11] 3,984,878

[45] Oct. 12, 1976

[54] WATER CLOSET

[76] Inventor: John J. Grasseschi, 1 Derby St., Worcester, Mass. 01604

[22] Filed: Sept. 25, 1975

[21] Appl. No.: 617,495

[52] U.S. Cl. ..... 4/34; 4/67 A; 4/69 R

[51] Int. Cl.[2] ..... E03D 1/22; E03D 1/30; E03D 3/00; E03D 3/12

[58] Field of Search ..... 4/67 A, 34, 44, 37, 4/57 R, 57 P, 67 R, 1, 18, 249, 12, 41, 69

[56] References Cited

UNITED STATES PATENTS

| | | | |
|---|---|---|---|
| 1,947,439 | 2/1934 | Crane et al. | 4/69 |
| 1,957,809 | 5/1934 | Schossow | 4/69 |
| 2,164,319 | 7/1939 | Groenigen | 4/69 |
| 2,187,738 | 1/1940 | Groenigen | 4/69 |
| 2,923,012 | 2/1960 | Kohlmeyer | 4/12 |
| 3,086,217 | 4/1963 | Barlow | 4/41 |
| 3,172,128 | 3/1965 | Ducey | 4/41 |

*Primary Examiner*—Henry K. Artis

*Attorney, Agent, or Firm*—Norman S. Blodgett; Gerry A. Blodgett

[57] ABSTRACT

A water closet in which a substantial reduction in water use is accomplished by flushing liquid waste from the bowl using a high-pressure stream of water which passes through the bowl and into an S-trap. Solid material is flushed in the normal way. The high pressure stream occurs in two phases; a first phase which has high momentum and evacuates the bowl, and a second phase which has low momentum and refills and reseals the bowl.

10 Claims, 11 Drawing Figures

WATER CLOSET

BACKGROUND OF THE INVENTION

One of the major difficulties facing mankind is the water supply sewage treatment problem. As the population of the earth increases, the amount of potable water necessary to keep humanity alive also increases as does the amount of water pollution generated by humanity. Extrapolation of present trends portends disaster. On the local and more immediate level, United States cities and towns find themselves caught in a vicious circle in which outrageously expensive water supplies and sewage treatment facilities are obsolete and inadequate even before they are built and long before they are paid for. The answer to these problems is that man must reduce the amount of water he transforms to sewage.

A major contributor to this water supply-sewage treatment problem is the 12,000 gallons per year that each person in the United States flushes down the toilet. This huge water use provides a potentially fruitful area for financial and ecological economies because of two factors. First, of course, is the obvious wastefulness of using the standard 5 to 7 gallons of flush water (which is necessary to exhaust solid matter) to exhaust a few fluid ounces of urine. The use of this massive amount of flush water results in an extremely dilute, but, nevertheless, absolutely polluted effluent. The magnitude of the waste in this urine flush can only be appreciated if one considers the life sustaining value of 7 gallons of water. Second, the capacity (and thus cost) of sewage treatment plants is generally dependent on the volume of input liquid irrespective of concentration. Thus, the cost of treating the sewage is magnified many times by the seemingly useless added water present in many sewage systems, particularly due to the urine flush in the normal toilet. Although the facts of a modern world continuously increase the recent public interest in water conservation, inventors have long recognized the inefficiency of the standard toilet and have expended considerable effort to find solutions. One approach has involved recognition that the flushing of solid and of liquid wastes have considerably different water requirements. In accordance with this approach, a separate urine flushing system is provided along with the standard system. The two systems are duplicates except for the amount of water used. The added complexity of these systems, however, can predictably add to the difficulties in cost of production and in maintenance. In addition, for each model of toilet, it has been found that there is an optimum amount of water necessary to achieve proper "flushing action" and serious deviation (as in the case of two flush volumes) can result in unsanitary and dangerous conditions. "Flushing action" means the phenomenon which is the basis of toilet operation, in which the flooding of the toilet bowl with flush water causes a flooding of the down stream leg of an inverted U-shaped trap. This flooding of the down stream leg initiates syphoning action which evacuates any liquid or suspended matter in the bowl. Particularly critical is the height of the weir (or bight) of the inverted U-shaped trap. Attempts at designing a weir of variable height have resulted in complicated mechanical structures which do not conform with national or local sanitary codes.

Another approach has been to retain the single flush concept but to improve the efficiency of the "flush action" so that less water is needed to accomplish a sanitary and effective flush. At the present time, toilets are commercially available which operate on 3½ gallons of water per flush, as opposed to the standard 5 to 7 gallons per flush. Nethertheless, while 3½ gallons of water is found to be the minimum necessary to achieve the flushing action, this amount is still an extravagant waste of water to flush urine.

A third and more general approach involves a complete re-examination of flushing equipment. This approach is exemplified by U.S. Pat No. 3,843,978 to Ragot. In the Ragot patent all of the tanks, floats and mechanical paraphernalia are dispensed with. In their place electrically operated switches operate a high-pressure water jet in the trap to initiate the flushing action and a high-pressure water jet in the bowl to generate swirling, scouring effect. Electrical sensors regulate and control the jets and refill.

Each of the designs incorporating various radical departures from conventional design have serious drawbacks, however. For example, whenever electrical controls are integrated with plumbing fixtures, there results not only the well-known dangers of electrical shock, but also the practical difficulties of installation and maintenance in view of the distinction between the various skilled trades. These and other difficulties experienced with the prior art devices have been obviated in a novel manner by the present invention.

It is, therefore, an outstanding object of the invention to provide a toilet which utilizes the minimum amount of flush water to achieve a sanitary and effective flush.

Another object of the present invention is the provision of a toilet which provides separate flush cycles for liquid and solid waste.

A further object of the instant invention is the provision of a toilet which minimizes the deviation from standard designs in order to facilitate acceptance by the plumbing industry and the public and thereby most rapidly eliminate flush water waste.

It is another object of the invention to provide a toilet having a separate urine flush cycle which effectively flushes the bowl and refills it with approximately one gallon of water, several times less than the minimum amount now used.

A still further object of the invention is the provision of a toilet having a separate urine flush cycle having all-mechanical controls which are simple, reliable and capable of a long and useful life with minimum maintenance.

It is a further object of the invention to provide a toilet having a novel flush control valve which mimimizes waste of water in the flush cycle.

It is a still further object of the present invention to provide a toilet which utilizes a high pressure water stream in the bowl to evacuate thee water in the bowl.

With these and other objects in view, as will be apparent to those skilled in the art, the invention resides in the combination of parts set forth in the specification and covered by the claims appended hereto.

SUMMARY OF THE INVENTION

This invention involves a toilet comprising a bowl having a first wall and an oppositely-facing rear wall, an S-trap associated with said bowl and adjacent the rear wall of the bowl, a transition port connecting the bottom of the bowl to the S-trap, a first nozzle, and a control valve system. The S-trap consists of an upwardly-extending part enabling a reserve of water to be maintained in the bowl, a weir limiting the amount of reserve water, and a down-stream leg which, when flooded, causes the reserve of water to be exhausted from the bowl. The first nozzle is positioned a substantial distance up the front wall, the nozzle being connected to a source of high-presssure water and aimed at and adapted to direct a high-pressure stream of water through the transition port. The control valve system is adapted to cause the nozzle to direct the stream at the transition port for a fixed period of time subsequent to activation of the valve system, the period being divided into a first, high-momentum portion and a second, low-momentum portion.

BRIEF DESCRIPTION OF THE DRAWINGS

The character of the invention, however, may be best understood by reference to one of its structural forms, as illustrated by the accompanying drawings in which.

DESCRIPTION OF THE PREFERRED EMBODIMENT

Figure 1:
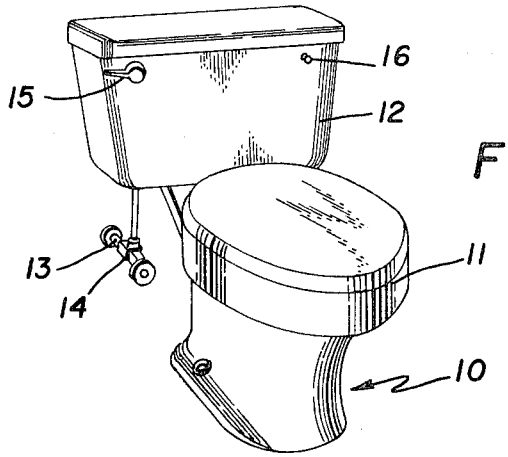
FIG. 1 is a perspective view of a toilet embodying the principles of the present invention.

Referring first to FIG. 1, in which are shown the general features of the present invention, the toilet, designated by the numeral 10, is shown to include a base 11 and a tank 12. Entering the tank 12 is the normal household supply line 13 (normally delivering about 60 psi) and a shutoff valve 14. On the face of the tank 12 are a solid flush handle 15 and a urine flush actuator 16. Within the tank 12 are all of the conventional mechanisms used in flushing a toilet. The base 11 and its associated exhaust system are of generally standard configuration.

Figure 2:
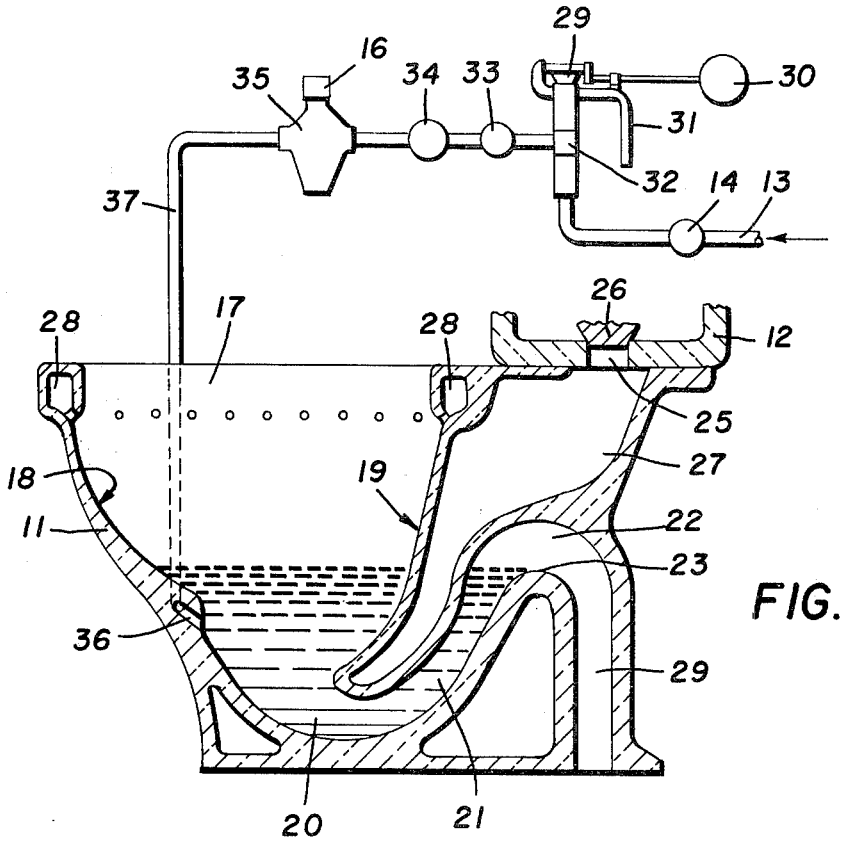
FIG. 2 is a cross-sectional view of the toilet and including a diagrammatic representation of the water supply system.

Referring now to FIG. 2, a cross-sectional view of the base 11 and a diagrammatic view of various water supply elements are shown. As mentioned above, the base is of more or less standard construction having a bowl 17 with a front wall 18 and a rear wall 19. At the bottom of the bowl is a transition port 20 which leads to an upwardly-extending part or leg 21 of an inverted U-shaped trap 22. The bye of the U-shaped trap 22 forms a weir 23 which limits the amount of water which can be accumulated in the bowl 17. From the bye of the U-shaped trap extends a downstream leg 24 which leads to the sewage system and which, when flooded, causes a syphon for "flush action" to empty any water from the bowl 17.

Mounted on the base 11 is the tank 12 which accumulates a quantity of water for the solid flush. At the bottom of the tank 12 is an aperture 25 plugged with a stopper 26 which is connected to the solid flush handle 15 in the normal manner. The aperture 25 leads into flush conduits 27 and 28. Flush conduit 27 floods the bowl and thus the U-shaped trap to cause the "flushing action," while conduit 28 feeds apertures around the upper rim of the wall to cleanse the upper walls of the bowl 17.

Water for the toilet is provided from the regular household supply through supply line 13 and shut-off valve 14 to the standard ball cock 29 and float 30 arrangement. The ball cock 29 has a nozzle 31 which fills the tank 12. A tee 32 in the ball cock 29 supplies water to a back-flow preventor 33, a reducing valve 34 and a control valve system 35. Where supply pressure is of normal and relatively constant value, the reducing valve 34 is not necessary. It does serve to optimize a given closet design to a wide range of site conditions. On the control valve system is the urine flush actuator 16. From the control valve system 35, the water is delivered to a first or main nozzle 36. Thee main nozzle 36 is positioned a substantial distance up the front wall 18 of the bowl 17, but below the height of the weir 23 and thus the normal water level in the bowl. The nozzle 36 is aimed at the transition port 20 and thus into the upwardly-extending part 21 of the trap. It can be seen that this embodiment of the present invention involves very little change in standard toilet design. The tee 32 and associated equipment up to the control valve system 35 would be positioned within the tank 12 with the urine flush actuator extending from the tank as shown in FIG. 1. The supply line 37 to the nozzle could be cast in the porcelain of the toilet itself as could the nozzle 36.

The operation of this embodiment of this invention involves separate cycles for liquid and solid waste which will conform with all state and national plumbing codes. The solid flush cycle takes place in the standard and well-known manner, and if the toilet is designed to modern standards, the solid flush can be accomplished effectively with approximately 3½ gallons of water.

Figure 3:
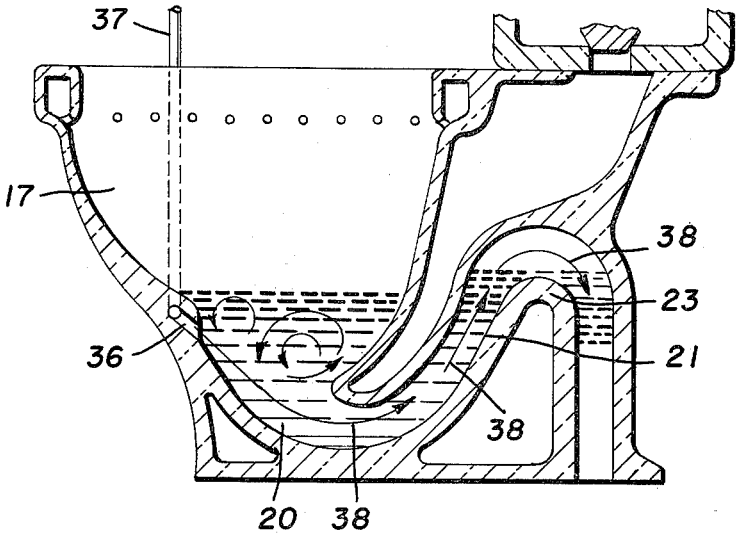
FIG. 3 is a cross-sectional view similar to FIG. 2 and showing a portion of a flush cycle.

Referring to FIG. 3, the liquid flush cycle operates on an entirely different concept. The high-pressure water from supply line 37 through main nozzle 36 forms a stream 38 (indicated by arrows) which is directed toward the transition port 20 and diverted up the upwardly extending part 21. The liquid flushing cycle itself is divided up into a first portion in which the stream 38 is of high momentum and a second portion in which the stream 38 is of a low momentum. The momentum of the stream 38 is controlled by control valve system 35.

The operation of the liquid flushing cycle is dependent on two somewhat distinct phenomenon. The first phenomenon is that when a high-momentum stream of fresh water is directed through the body of polluted water in the bowl 17, the resulting turbulence causes the polluted water to enter and become part of the high-momentum stream with only a small loss of fresh water to the body of water in the bowl. Thus, the stream of water will tend to absorb the polluted water. The second phenomenon is the effect that the momentum of the stream 38 has on the mass of water in the upwardly directed part 21 of the trap. At low-momentum values, the energy of the stream is dissipated over its path through the bowl and upwardly extending part of the trap so that the stream merely adds water to the reserve in the bowl and trap, eventually causing slight flow over the wier 23. At momentums above a critical value, which depends on the design of the toilet itself, the energy of the stream 38 is sufficient to drive plugs of water over the weir to flood the downstream leg 24 and initiate flushing action which empties the bowl.

Thus, in the first portion of the urine flushing cycle a stream 38 having a momentum above the critical value necessary to initiate the flushing action is directed through the bowl and trap, causing evacuation of the bowl. With the supply line 37 being equivalent to a ⅜ inch O.D. tube delivering at 40 psi, the flushing action can be initiated with approximately half a gallon of water. In the second portion of the cycle, a low-momentum stream simply delivers water to refill the bowl up to the level of the weir. This requires approximately another half gallon of water depending on the design of the toilet. At the rate of approximately 1 gallon per urine flush, the present invention would save approximately 5,000 gallons of flush water per person per year.

Figure 4:
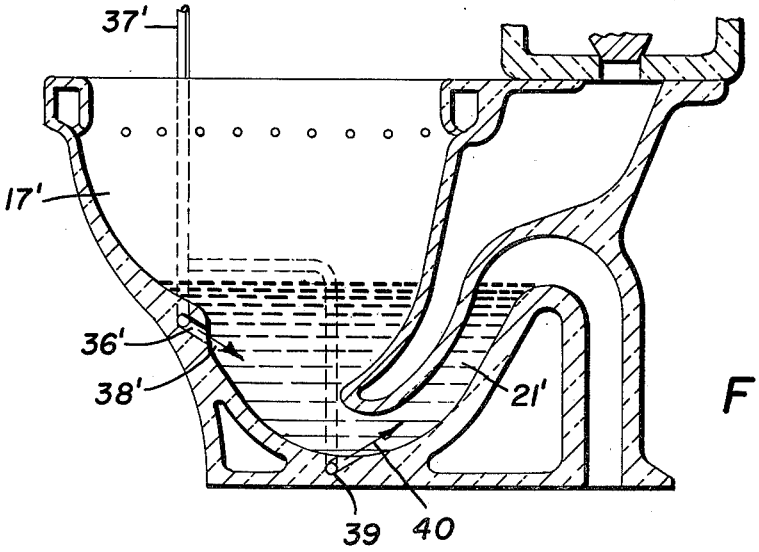
FIG. 4 is cross-sectional view of another toilet embodying the principles of the present invention.

One of the practical problems which must be addressed by the present invention is that small quantities of toilet paper often accompany the urine which must be flushed away. The above described embodiment can handle this situation quite reliably, particularly if the supply line 37 is allowed to deliver the water at the 60 psi which is the standard household supply pressure. Where available pressures are not sufficient or where larger quantities of paper pulp are anticipated, a secondare nozzle 39, located at the lowest part of the upwardly extending part 21' increases the capability of the system to carry paper by providing a secondary stream 40 as shown in FIG. 4.

Figure 5:
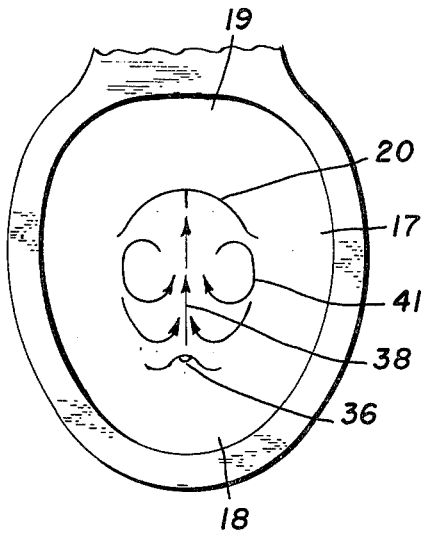
FIG. 5 is a diagrammatic view looking into the bowl of a toilet and showing the turbulence caused by a system embodying the principles of the present invention.
Figure 6:
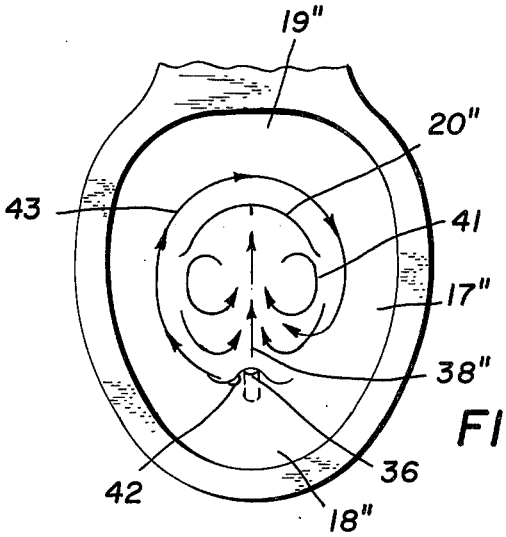
FIG.6 is similar to FIG. 5 but shows a variation of the nozzle design.

Another difficulty which the present invention must address is the provision of a scouring action to remove residue from the walls of the bowl 17. It has been found that where liquid waste and paper pulp are the only pollutants in the bowl water, the turbulence generated by the primary stream 38 is sufficient to scour the walls of the bowl. This natural turbulence is shown diagrammatically as arrows 41 in FIG. 5. It is possible that certain bowl configurations might so suppress the turbulence at the water line that the natural turbulence is insufficient to provide the desired degree of scrubbing. In this case, an auxiliary nozzle 42 is provided adjacent the main nozzle 36 inches and adapted to direct a stream of water 43 around the periphery of the water line to provide additional scrubbing, as shown in FIG. 6.

Figure 7:
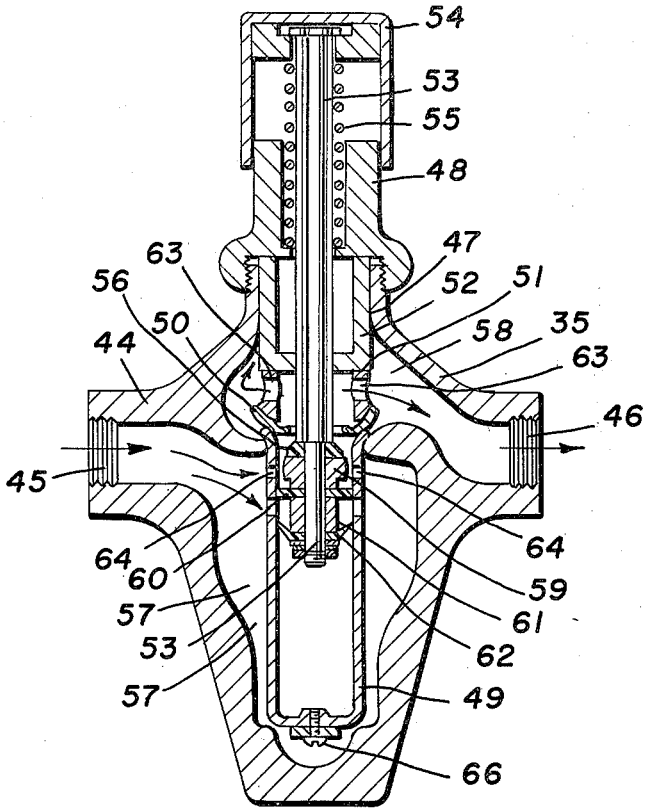
FIG. 7 is a cross-sectional view of a control valve which is part of the present invention.

The accomplishment of the above-mentioned urine flush cycle with its first, high-momentum portion and its second, low-momentum portion, requires manipulation, by the control valve system 35, of the water pressure delivered to the main nozzle 36. A cross-sectional view of the control valve system 35 of the present invention is shown in FIG. 7. This system 35 includes a valve body 44 having an input port 45, an exit port 46, and an access port 47. Threadedly engaged to the body 44 and covering the access port 47 is a cap 48. The cap locks a dashpot 49, a seat 50, a port sleeve 51, and a sleeve 52 coaxially within the body 44. Coaxially within the above-mentioned coaxial elements and slidably mounted in the cap 48 is a stem 53, which is attached to a movable button 54 and biased in an upward direction by spring 55. Mounted on the stem 53 are a seat washer 56 which forms a seal with the seat 50 between the lower cavity 57 and the upper cavity 58 of the body 44, a retainer 59, a seal washer 60 whose outer peripheral edge engages the wall of the dashpot 49, a spacer 61, and a feather-edged washer 62.

The port sleeve 51 includes flow ports 63 which allow radial flow of liquid with respect to the stem through the port sleeve 51. The dashpot 49 has two sets of flow ports axially spaced from one another. The low-flow ports 64 are spaced adjacent the upper or seat end of the dashpot so that they are closer to the seat 50 than the distance between the seat 50 and the seal washer 60. The high flow ports 65 are a greater distance from the seat 50 than the distance between the seat 50 and the seal washer 60 when the seat washer 56 is engaged with the seat 50. The dashpot also has an adjustable leak 66 at its lower end.

Thus, as will be described in further detail below, the normal flow of water through the valve system 35 is into the input port 45 to the lower cavity 57, through the dashpot walls by means of low-flow ports 64 and high-flow ports 65 (depending on the position of the stem 53), and through the seat 50 and seat washer 56 if they are not engaged. The flow then proceeds through the flow ports 63 of the port sleeve 51 into the upper cavity 58, and then outward of the valve system through exit port 46.

Figure 8:
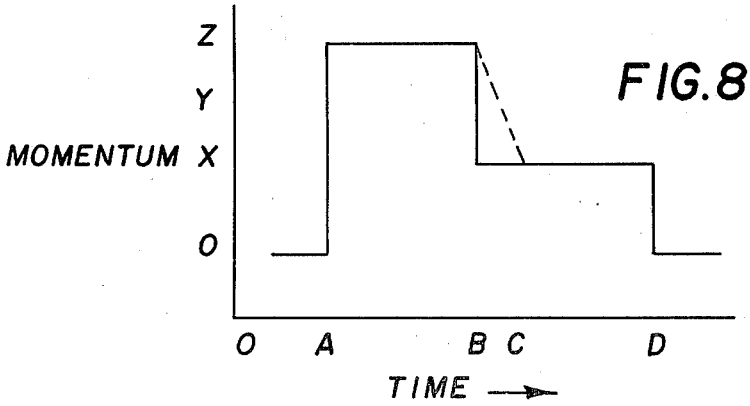
FIG. 8 is a graphic representation of the flow cycle caused by the control valve in FIG. 7.

Referring now to FIG. 8, when the momentum of the stream exiting from the primary nozzle 36 is plotted as a function of time, the nature of the cycle becomes more clear. From time 0 to time A, when the button 54 of the valve system 35 is pressed into the valve body 44, the momentum of the stream is zero. At time A the button 54 is pressed and the momentum immediately climbs to a value Z which is above the critical value Y. Time A to time B is the high-momemtum portion of the cycle which must be of sufficient duration to exhaust any pollution from the bowl; in the preferred embodiment, about 15 seconds. During this time the flow remains constant at a value Z. Following time B at which the pollution in the bowl has been exhausted, a transition zone between time B and C would normally occur. In this transition zone, the momentum drops from a value C to a value X which is below the critical value Y. While the solid line on the graph represents the ideal drop between pressures, which could be achieved using two separate seat-washer-type valves, one of which would close at time B, in the preferred embodiment, the transition would be more gradual as shown by the dash line. The second or low-momentum portion of the cycle would go from time C or the time that the momentum falls below the critical value until time D when the bowl has become sufficiently full to achieve a proper gas seal. At this D, the valve system would close off water to the main nozzle and the momentum would fall to zero again.

Figure 9:
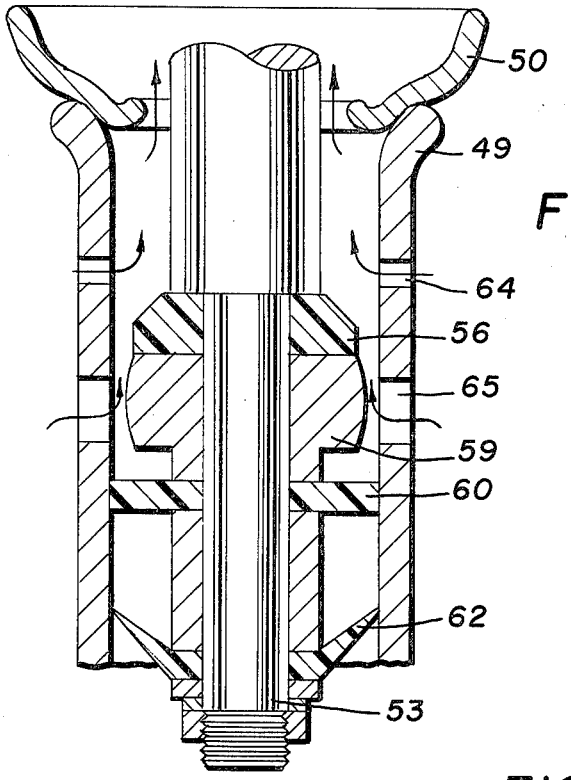
FIG. 9 is a cross-sectional view showing a close-up of the action of the valve shown in FIG. 7.
Figure 10:
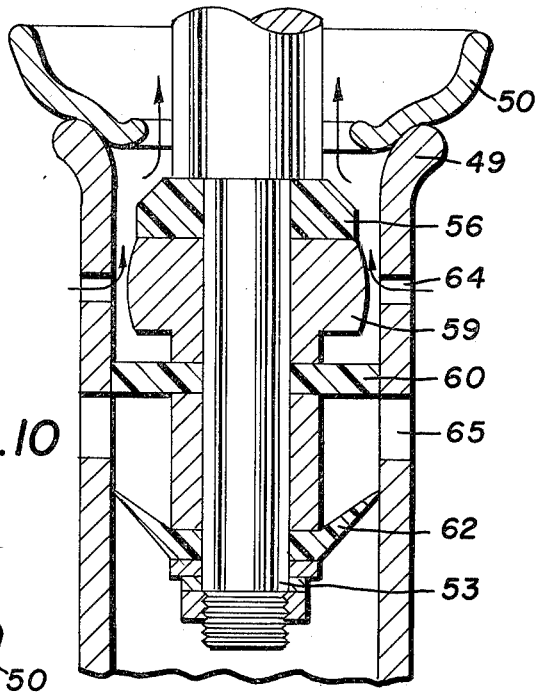
FIG. 10 shows the subject of FIG. 9 in a slightly different position.
Figure 11:
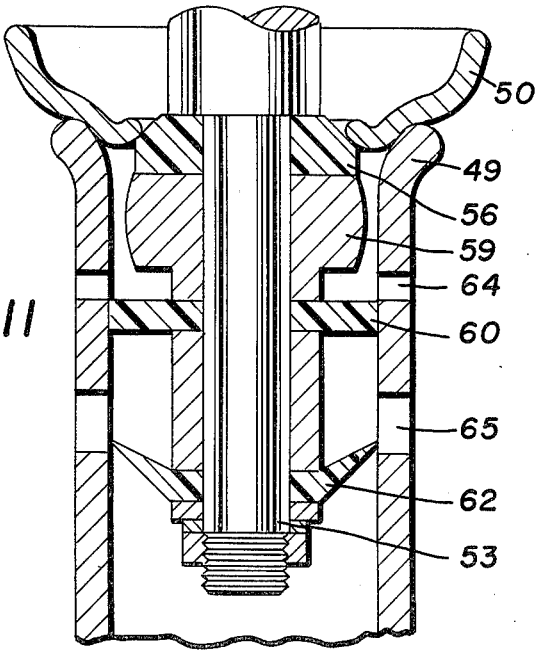
FIG. 11 shows the subject of FIG. 9 in a still different position.

The manner in which the valve system 35 causes the momentum variation shown in FIG. 8 is represented in detail in FIGS. 9–11. FIG. 9 shows the position of the valve internals after the button 54 has been pushed in. As stem 53 moves downward, water which has filled the dashpot is allowed to move around the feather-edged washer 62. When the pressing of the button ceases, the spring 55 biases the stem 53 upward. However, the feather-edge washer stops flow of water into the dashpot below it and a suction is created which stops the stem return upward. Since the return can only occur if water is allowed to enter the lower end of the dashpot, the degree of opening of the adjustable leak 66 will determine the speed at which the stem returns to its original position. In the downward most position of the stem 53 (shown in FIG. 9), flow is allowed through both the low-flow ports 64 and the high-flow port 65 and thence upward through the opening in the seat 50. This high-flow pattern occurs because the seal valve 60 is below both sets of flow ports 64 and 65. This situation represents the first, high-momentum portion of the flush cycle shown between times A and B.

FIG. 10 shows the valve internals at time C. At this point, seal washer 60 has moved upward past high-flow ports 65 thus closing them off. As a result, flow is restricted to flow through low-flow port 64. As the stem continues to move upward, the flow will remain relatively constant between times C and D.

FIG. 11 shows the valve internals at time D. The seat washer 56 has engaged the seat 50 and thus provides a positive closure of the valve system. The flow and thus the momentum remains at zero.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A toilet capable of selective operation in two modes, one of which is a partial flush and the other of which is a full flush, comprising a. a bowl having a front wall and an oppositely facing rear wall and a tank connected thereto, b. an S-trap associated with said bowl and adjacent the rear wall of the bowl, said S-trap comprising an upwardly extending part enabling a reserve of water to be maintained in said bowl, a weir limiting the amount of reserve water, and a downstream leg which, when flooded, causes the reserve of water to be exhausted from the bowl, c. a transition port connecting the bottom of the bowl to the S-trap, d. a first nozzle positioned a substantial distance up the front wall, the nozzle being connected to a source of high-pressure water and aimed at and adapted to direct a high-pressure stream of water at the transition port, and e. a control valve system for use in the full flush mode and adapted to cause the nozzle to direct the stream at the transition port for a fixed period of time subsequent to actuation of the valve system.

2. A toilet as recited in claim 1, wherein a second nozzle is positioned at the lowest portion of the bowl and adapted to direct a stream of water up the upwardly extending part of the S-trap.

3. A toilet as recited in claim 1, wherein a scrub nozzle is provided adjacent the first nozzle and adapted to direct a stream of water horizontally about the inner surface of the bowl.

4. A toilet as recited in claim 1, wherein the toilet has a standard ball cock and the source of high-pressure water is at the upstream end of the standard ball cock.

5. A toilet as recited in claim 1, wherein a critical value of mementum in the stream from the first nozzle is necessary to drive water over the weir and the control valve system manages the flow through the first nozzle so that the fixed period of time subsequent to actuation of the valve system is divided into a first portion in which the momentum is above the critical value and a second portion in which the momentum is below the critical value.

6. A toilet as recited in claim 5, wherein the valve system includes a valve which, subsequent to actuation, remains fully open during the first portion and slowly closes.

7. A toilet as recited in claim 5, wherein the valve system includes a first and a second valve, both of which are adapted to deliver water to the first nozzle.

8. A toilet as recited in claim 7, wherein, during the first portion of the fixed period of time, the first and second valves are both open, and during the second portion, only the second valve is open.

9. A toilet as recited in claim 8, wherein the first and second valve share a common stem and are both opened by actuation of the common stem.

10. A toilet as recited in claim 1, wherein a complete standard flushing system is present.

* * * * *